United States Patent [19]

Larson

[11] 4,305,208

[45] Dec. 15, 1981

[54] SIGHTING APPARATUS

[76] Inventor: Marlow W. Larson, 2735 S. 4050 W., Ogden, Utah 84401

[21] Appl. No.: 76,190

[22] Filed: Sep. 17, 1979

[51] Int. Cl.[3] ..... F41G 1/00; F41B 5/00

[52] U.S. Cl. ..... 33/265

[58] Field of Search ..... 33/265

[56] References Cited

U.S. PATENT DOCUMENTS

| | | | |
|---|---|---|---|
| 2,542,501 | 2/1951 | Fredrickson | 33/265 |
| 2,767,472 | 10/1956 | Kocur | 33/265 |
| 2,875,522 | 3/1959 | Merrill et al. | 33/265 |
| 2,987,820 | 6/1961 | Butts | 33/265 |
| 2,998,652 | 9/1961 | Zielinski | 33/265 |
| 3,013,336 | 12/1961 | Pennington | 33/265 |
| 3,084,442 | 4/1963 | Jacobson et al. | 33/265 |
| 3,355,809 | 12/1967 | Gurton | 33/265 |
| 3,599,337 | 8/1971 | Snodgrass | 33/259 |
| 3,696,517 | 10/1972 | Larson | 33/265 |
| 4,020,560 | 5/1977 | Heck | 33/265 |

*Primary Examiner*—Steven L. Stephan
*Attorney, Agent, or Firm*—M. Ralph Shaffer

[57] ABSTRACT

A new and improved sighting device and range-finder and sighting device combination wherein the elemental sighting devices incorporate a sighting screw disposed within and through first and second separate mounting members having corresponding aligned apertures, one of the sighting members incorporating interiorly threaded means. The sighting devices themselves are constructed and arranged for gripping or clamping onto an elongate member and are selectively adjustable thereon. In a preferred form of the invention, irregular mating surfaces of such elongate member and the respective sighting devices used, prevent inadvertent slippage of such devices on the elongate member. The split-construction of the respective bodies sighting members enable users to install easily certain range indication markings as necessary, this obviating prior manufacturing expense. Fore and aft sighting-device mounting is provided. Vibrations during archery bow use, when such bows incorporate the range-finder, sighting device mechanism herein, will not disturb the unique, releasable mountings of individual sighting device elements on the elongate member of the unit.

12 Claims, 7 Drawing Figures

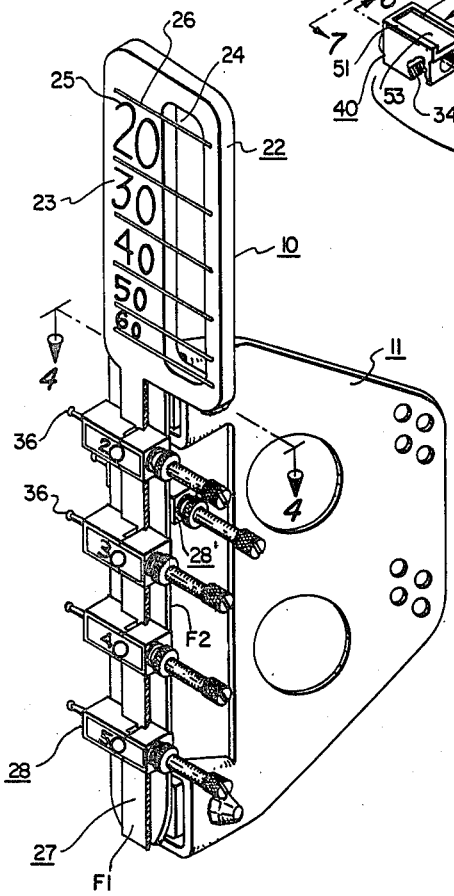
Fig. 1
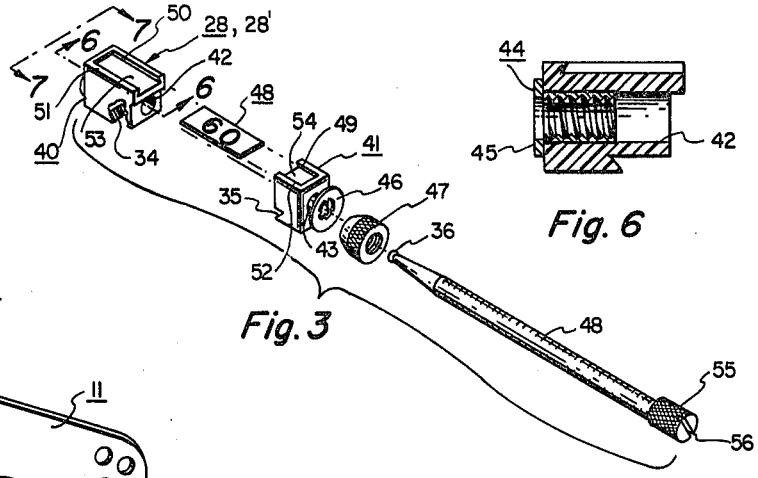
Fig. 3
Fig. 6
Fig. 4
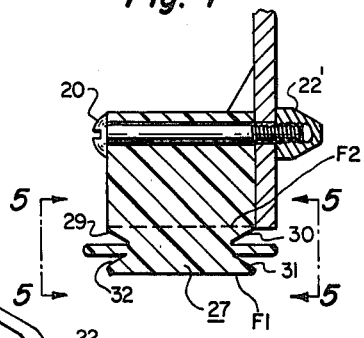
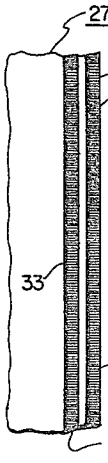
Fig. 5
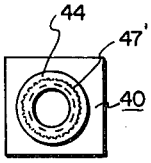
Fig. 7
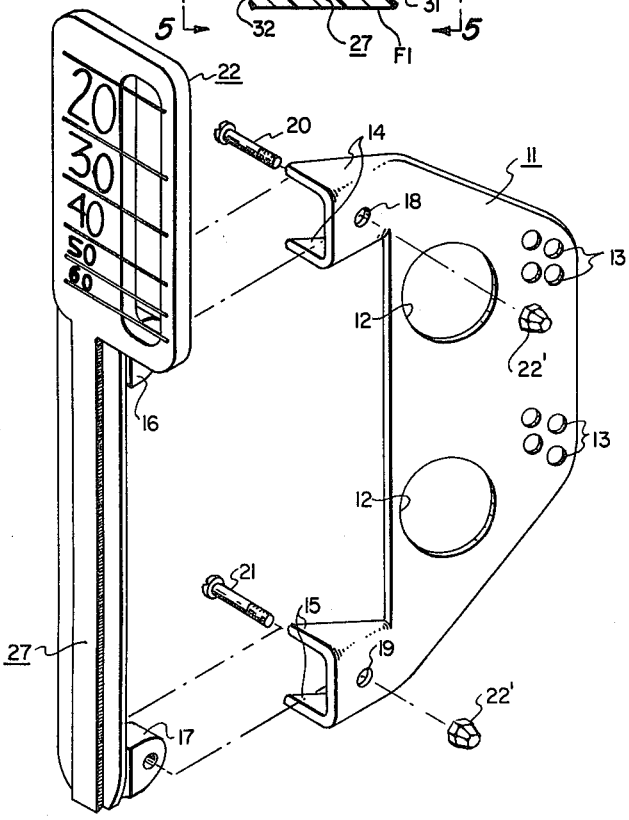
Fig. 2

SIGHTING APPARATUS

FIELD OF THE INVENTION

The present invention relates to range-finder and bow sight devices and, more particularly, to range-finder bow sight structure and elemental sighting devices employed therein, whereby manufacturing of the elemental sights can be made inexpensive, relative to costs generally associated with such devices; furthermore, the devices are serrated or otherwise provided with irregular surfaces cooperating with mating mounting surfaces whereby the devices are not jarred loose during archery-bow use. Finally, elemental sighting devices can be mounted fore and aft of the unit so as to provide further increments or steps as to ranges for which the bow will be useful.

PRIOR ART STATEMENT AND BRIEF DESCRIPTION OF PRIOR ART

The present invention is a modification over and, in certain respects, an improvement upon the inventor's prior U.S. Pat. No. 3,696,517, fully incorporated herein by way of reference. This patent is relevant upon the general point of range-finder bow sight devices; however, instead of using an integral slotted body for the sighting screws, the present invention employs two separate members designed to coact with and grip at the opposite sides of the vertical elongate member used and, thereby, provides for separate user insertion of numeral strips in the individual elemental sighting devices to indicate various sighting ranges.

Other U.S. patents which are known and which relate to archery bow sights in general are the following U.S. Pat. Nos.: 2,998,652; 2,875,522; 2,987,820; 3,013,336 and 3,084,442. These patents are relative in the employment of adjustable sights, threaded sighting screws, and the like. However, none of these structures teach range indicia plates which can be easily inserted by the user prior to installation of the elemental sighting devices on the bow attachment. Additionally, there is no teaching of fore and aft sight mounting, or of how an adjustable sight might be releasably fixed as to disposition by suitable means and in such a manner that the normal vibrations and jarrings of high-powered bows will not cause the sight mounting to become inadvertently loosened.

BRIEF DESCRIPTION OF THE PRESENT INVENTION

According to the present invention, sighting apparatus incorporates a depending elongate member to which are releasably attached a series of elemental sighting devices, preferably both fore and aft of such member. These are releasably slidable thereon but include irregular surface areas, such as ribbed areas cooperating with corresponding ribbed surfaces of such elongate member, whereby when the devices self-clamp onto such elongate member, they will not become inadvertently jarred loose. Additionally, separate members comprise the body of the individual sighting means, this so that these can be separated slightly and permit numeraled indicia plates to be positioned by the user in a composite face or support area defined by overlapping, undercut margins. In this way, manufacturing expense is substantially reduced, since the manufacturer now is not obliged to paint or otherwise dispose numeraled indicia upon the faces of the sighting devices. If desired, range indications on both the sighting devices and the range-finder may be color-coded for mutual correspondence. Increments between successive ranges can be further subdivided by sighting elements disposed on opposite sides of the usual sighting device mount.

OBJECTS

Accordingly, a principal object of the invention is to provide a new and improved sighting device.

A further object is to provide a new and improved range-finder and bow sight device.

An additional object is to provide structure for precluding the inadvertent slippage as between the sighting devices and their respective mounts.

An additional object is to provide for fore and aft mounting of elemental siding devices onto a holder or other elongate member, this such as to reduce increments between selectable ranges.

A further object is to provide in sighting devices certain elemental sighting device structures whereby numeral-bearing plates or strips can be easily disposed by the user within the recessed-face areas of the bodies of such devices, and this in a convenient manner.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF DRAWINGS

FIG. 1 is a perspective view of a range-finder and bow-sight device incorporating the principles of the present invention.

FIG. 2 is an exploded view of certain principal portions of the structure of FIG. 1.

FIG. 3 is an exploded perspective review of an elemental sighting device.

FIG. 4 is a transverse vertical section taken along the line 4—4 in FIG. 1.

FIG. 5 is a fragmentary elongated view, taken along the lines 5—5 in FIG. 4, both views being identical of the elongate member employed in the mounting structure, wherein the angulated faces which mate with the elemental sighting devices are shown to be ridged or serrated, for example.

FIG. 6 is an enlarged, longitudinal section taken along the line 6—6 in FIG. 3.

FIG. 7 is an end view taken along the lines 7—7 in FIG. 3.

DESCRIPTION OF PREFERRED EMBODIMENTS

In FIG. 1 the range-finder, bow-sight device 10 is shown to be mounted to a bracket 11, see FIG. 2. Bracket 11 is shown to include a series of lightening holes 12 and also mounting apertures 13, the latter being employed to mount bracket 11 and hence the device 10 to a conventional archery bow by the employment of any convenient attachments as by nuts or bolts disposed through apertures 13. The bracket 11 includes a respective pair of ears 14 and 15 that receive respective apertured bosses 16 and 17 of device 10. The apertures of these bosses are aligned with apertures 18 and 19 and are mounted thereat by attachments 20 and 21. Cap nuts 22', see FIG. 4, can be employed with the attachments 20, 21 by way of example.

Range finder portion 22, see FIG. 1, includes a frame 23 provided with aperture 24. Also, a series of range indicia as at 25 are provided, the same being disposed between cross bars 26. Integral with frame 23 is a vertical elongate slide member 27 having opposite faces F1 and F2 and on which respective sighting devices 28 are mounted as hereinafter described. At this point, it is appropriate to remark that the bosses 16 and 17 may be integral with elongate member 27, see FIG. 4 by way of example.

In a preferred form of the invention, device gripping surfaces 29–32 are oppositely sloping, relative to individual surfaces of the separate pairs, and also are irregular or serrated as by being provided with respective pluralities of ribs 33. The irregularities may be knurled portions, points, or other types of irregularities; however, it is believed best to include a series of ribs both at surfaces 29–32 and also at the cooperating surfaces 34 and 35, hereinafter to be discussed, relative to the sighting devices 28.

It is important to note that the surface pair 29, 30 and also the surface pair 31, 32 accommodate the mounting, both forwardly and rearwardly of elongate member 27, of the several devices 28 and 28'. The device labeled 28' can be exactly the same as sighting device 28, albeit the prime (') notation is simply to indicate the reverse mounting of the device. This is especially useful, in case of modern-day high-speed archery bows, where close placement of sighting lines is needed. Accordingly, the various sighting devices 28 can be all pushed together and yet finer increments of sighting levels be made possible by the reverse mounting of devices 28' on the opposite side of member 27 so that the spacings between adjacent sighting beads 36 can be further divided.

Each of the sighting devices 28, or 28', is illustrated in FIGS. 3 and 6, in addition to FIG. 1. Thus, the first and second, separate mounting members 40 and 41 each include apertures 42 and 43. Preferably, member 40 will be provided with an interiorly threaded insert such as shown at 44 in FIG. 6. This will include a head 45 and also a body 47' that is exteriorly splined so as to be pressed into and retained in fixed position with aperture 42. The threaded sighting screw 48 is provided with a knurled head 55 having a key slot 56 which can be used by screw driver, key or coin in order to appropriately rotate this screw for proper azimuth position of bead 36. Starwasher 46 and locking nut 47 are also employed. An indicia plate 48 is employed and may take the form of simply a numbered Mylar strip or other suitable material that can easily be slipped within the undercut margins 49 and 50 as formed by respective overlapping three-sided lip configurations 51 and 52 of respective members 40 and 41. The faces 53 and 54 thus form a backing for strip 48.

The design features for the device 28, 28', in incorporating separated members 40 and 41, provide for an appropriate gripping action relative to elongate member 27 and, in addition, allow for the insertion of the numeraled strip or plate 48. This saves considerable manufacturing expense since the sight device can be sold to the user and the same simply disassembled or loosened sufficiently so that the user himself can take one of the appropriate strips in the supplied package and insert it into members 40 and 41 as previously described. This saves considerable manufacturing expense since, otherwise, the manufacturer would be obliged actually to paint or otherwise dispose the number on each sighting device.

The ribbed or regular surfaces at 34 and 35, comprise rib pluralities the orientation of which is transverse to the longitudinal dimension of the surfaces involved. These ribs will intermesh with the ribs or other irregularities of member 27, see surfaces 29–32 in FIG. 5 so that the rib-intermesh resulting thereby will tend to fixedly retain the sighting devices 28 in place once the nuts are adjusted so as to cause a gripping of the respective sighting devices to member 27. Once the gripping is accomplished the azimuth screws of course can be easily adjusted. A slight inadvertent loosening of the screws, or of their locking nuts, will not produce a disorientation of the sighting devices through their sliding downwardly; rather, the intermeshed ribs will tend to keep the devices in place. This is most important because frequently the severe vibrations and shock accompanied by bow usage will tend to loosen the placement of the various sighting devices. This undesirable feature is obviated by the employment of irregular surfaces as between the sighting devices and the elongate member 27 to which they are releasably attached.

Also, to be further emphasized, is the point that even the pressing together of the sighting devices does not restrict range differences for fast bows but, rather, the additional sighting devices on the opposite side can be used to further divide spacings between sighting beads 36.

The respective numerals 25 of the range finder and the numerals on plates 48 may be color-coded in mutual correspondence for the respective ranges shown.

Other than above described, the apparatus will operate as explained in the inventor's U.S. Pat. No. 3,696,517 which is fully incorporated herein by way of reference.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of the invention.

I claim:

1. A sighting device including, in combination, first and second separate mounting members having corresponding aligned apertures, one of said apertures being provided with interiorly threaded means, an externally threaded sighting screw disposed in and through said apertures and threadedly engaging said threaded means, and nut means threaded on said sighting screw for urging said mounting members mutually toward each other, each of said mounting members having a recessed face defined in part by undercut lip margins, said faces being mutually coplanar and aligned at their mutually proximate portions whereby to form a common backing, and a plate bearing range-indicia and inserted in and across said mounting member faces beneath said undercut lip margins to be backed by said common backing as formed by said faces.

2. The structure of claim 1 wherein said mounting members are of molded plastic, that one of said mounting members having said threaded means being provided with an exteriorly-splined internally-threaded metal insert comprising said threaded means and pressed into its respective one of said apertures.

3. The structure of claim 1 wherein said first and second members have respective inwardly facing ribbed surface means for mutually gripping an external member when said nut means is tightened.

4. The structure of claim 1 wherein said sighting screw is provided with a star washer disposed between said nut means and a respective one of said mounting members.

5. The structure of claim 1 wherein said nut means coacts toward and with that mounting member not provided said threaded means.

6. The structure of claim 1 wherein said plate comprises a number-bearing strip.

7. The structure of claim 1 wherein said sighting screw has a knurled heat at one end and a sighting bead at the remaining end.

8. The structure of claim 3 wherein said surface means comprise respective undercut surfaces and are provided with parallel grooves forming gripping ribs and oriented in respective directions transverse to the longitudinal direction of said undercut surfaces.

9. A sighting mechanism, including, in combination, an elongate member provided with opposite vertically elongate faces and also opposite sides each having plural oppositely sloping vertically elongated surfaces longitudinally oriented in parallel directions and each surface having respective pluralities of ribs, opposite-face-reversible first and second separate members having respective ribbed surfaces engaging respective and corresponding ones of opposite side surfaces, in inter-ribbed engagement, and sighting means, including threaded grip-producing means, for effecting the releasable gripping of said first and second members onto said elongate member in a selected disposition on either of these faces.

10. A sighting mechanism included, in combination, an elongate member provided with opposite vertically elongate faces and also opposite sides each having plural oppositely sloping vertically elongated surfaces longitudinally oriented in parallel directions and each surface having respective pluralities of irregularities, opposite-face-reversible first and second separate members having respective irregular surfaces engaging respective and corresponding ones of said side surfaces, in inter-rib engagement, and threaded sighting means for effecting the releasably gripping of said first and second members onto said elongate member in a selected disposition on either of said faces thereof.

11. In a bowsight, an elongate slide support provided with opposed forward and rearward faces having forward and rearward pairs of irregular sight-gripping surfaces, respectively, and plural equivalently-dimensioned sighting devices, provided with threaded sight-to-slide-support gripping means, adjustably and respectively mounted over said opposed faces of said slide support, on respective pairs of said sight-gripping surfaces of said slide support, whereby to enable a staggering of said sighting devices and thereby accommodate reduced incremental range settings.

12. A range-finder bowsight device including, in combination, a range-finder portion having a multiplicity of fixedly disposed horizontal crossbars adjacent ones in which to find respective, separated, light-transmissive viewing spaces of respective, unique heights, said range-finder portion including respective identifying said spaces as to ranges represented thereby as when a target of given height, when viewed by a user, visibly fills exactly a respective, determined one of said spaces when said target is at a range corresponding to that of the indicia means of the space through which said target is viewed; a bow-sight portion comprising a depending, elongate support having forward and rearward opposite faces, and a plurality of expandable split sighting means, for respectively sighting targets at respective ranges established by said range-finder portion as identified by said indicia means, slideably mounted upon and over said opposite faces of said elongate support and provided with respective threaded sighting elements for adjustably and releasably gripping said split sighting means over said elongate support, surfaces of said sighting means and said elongate support which interengage being provided with irregularities that intermesh; and means for mounting said device to a bow.

* * * * *